US006837171B1

(12) United States Patent
Clark et al.

(10) Patent No.: US 6,837,171 B1
(45) Date of Patent: Jan. 4, 2005

(54) LIGHTWEIGHT TABLE WITH UNITIZED TABLE TOP

(75) Inventors: Roger A. Clark, Milwaukee, WI (US); Charles Richard Skovira, Jr., Mount Holly Springs, PA (US)

(73) Assignee: Palmer/Snyder Furniture Company, Milwaukee, WI (US)

( * ) Notice: Subject to any disclaimer, the term of this patent is extended or adjusted under 35 U.S.C. 154(b) by 0 days.

(21) Appl. No.: 10/134,421

(22) Filed: Apr. 29, 2002

(51) Int. Cl.[7] ..... A47B 3/00

(52) U.S. Cl. ..... 108/131; 108/161

(58) Field of Search ..... 108/115, 27, 153.1, 108/180, 186, 157.1, 157.14, 157.18, 158.11, 158.12, 159, 157.12, 161

(56) References Cited

U.S. PATENT DOCUMENTS

| | | | | |
|---|---|---|---|---|
| 2,786,727 A | * | 3/1957 | Nordmark | 108/27 |
| 3,676,279 A | * | 7/1972 | Beaver | 428/73 |
| 3,765,993 A | | 10/1973 | Raffensparger et al. | |
| 3,866,550 A | | 2/1975 | Geschwender | |
| 4,621,006 A | | 11/1986 | Terry et al. | |
| 4,645,171 A | | 2/1987 | Heide | |
| 4,822,661 A | | 4/1989 | Battaglia | |
| 4,853,065 A | | 8/1989 | Terry et al. | |
| 4,951,576 A | | 8/1990 | Cobos et al. | |
| 5,021,282 A | | 6/1991 | Terry et al. | |
| 5,034,256 A | * | 7/1991 | Santiso et al. | 428/73 |
| 5,061,541 A | | 10/1991 | Gertel | |
| 5,154,963 A | | 10/1992 | Terry | |
| 5,271,338 A | | 12/1993 | Bonham | |
| 5,311,825 A | | 5/1994 | Bonham | |
| 5,394,808 A | | 3/1995 | Dutro et al. | |
| 5,443,020 A | | 8/1995 | Price | |
| 5,461,989 A | | 10/1995 | Grandclement et al. | |
| 5,500,269 A | | 3/1996 | Terry | |
| 5,505,142 A | | 4/1996 | Fink | |
| 5,558,920 A | | 9/1996 | Heide | |
| 5,623,882 A | | 4/1997 | Price | |

(List continued on next page.)

FOREIGN PATENT DOCUMENTS

| | | | |
|---|---|---|---|
| EP | 1095592 | | 5/2001 |
| JP | 09000356 | * | 1/1997 |
| WO | WO 90/04515 | | 5/1990 |

OTHER PUBLICATIONS

DuraLite Tables; 7 pages from catalog date unknown.
Lifetime Products, Inc. "Dura Table Utility" Catalog; 3 pages date unknown.
McCourt Manufacturing; "Series 5 Folding Chairs" catalog; 7 pages date unknown.
Midwest; "The Midwest Advantage" catalog; 3 pages date unknown.
Virco Furniture "Education Catalog" Dated: 2001.
McCourt Manufacturing date unkown.
Virco; 6 pages of specification and catalog excerpts Dated: Jun. 16, 1997.
Mity–Lite; 9 pages of catalog excerpts Dated: Oct. 11, 1998.

*Primary Examiner*—Janet M. Wilkens
(74) *Attorney, Agent, or Firm*—Jansson, Shupe & Munger, Ltd.

(57) ABSTRACT

A lightweight, portable table comprising a unitized table top member and legs secured to the table top member. The unitized table top member includes table top and bottom elements and a rigid support member. A hardened foam body is joined to the top and bottom table elements and is formed around the support member in sufficient volume to support the support member within the table top member. A lightweight core element is positioned within the table top member joined to the hardened foam body. The table advantageously requires few parts and is economical to manufacture yet is sturdy and easily transported.

49 Claims, 8 Drawing Sheets

U.S. PATENT DOCUMENTS

| | | | |
|---|---|---|---|
| 5,678,491 | A | 10/1997 | Price et al. |
| 5,694,865 | A | 12/1997 | Raab |
| 5,732,637 | A | 3/1998 | Raab |
| 5,804,278 | A | 9/1998 | Pike |
| 5,868,081 | A | 2/1999 | Raab |
| 5,894,044 | A | 4/1999 | Norcom et al. |
| 5,921,623 | A | 7/1999 | Nye et al. |
| 5,947,037 | A | 9/1999 | Hornberger et al. |
| D414,626 | S | 10/1999 | Collins et al. |
| 5,962,104 | A | 10/1999 | Gertel et al. |
| 5,983,807 | A | 11/1999 | Tarnay et al. |
| 5,992,127 | A | 11/1999 | Quinif |
| D417,965 | S | 12/1999 | Strong et al. |
| D419,332 | S | 1/2000 | Collins et al. |
| 6,058,854 | A | 5/2000 | Tarnay et al. |
| 6,090,464 | A | 7/2000 | Yoo |
| 6,109,687 | A | 8/2000 | Nye et al. |
| 6,112,674 | A | 9/2000 | Stanford |
| 6,116,167 | A | 9/2000 | Rabe |

* cited by examiner 10
19
23
127
25
93
101
83
107
103
95
149
131
163
111
85
151
125
33
165
97
105
89
159
109
87
187
81
21
199
99
185
191
145
55
91
161
147
193
189
195
153

10
139
137
135
127
123
131
129
87
63
73
147
35
25
153
27
157
29
155
121
75
81
55
57
121
61
59
121
79
37
141
201
189
195

10
123
131
129
167
63
73
147
35
25
27
121
75
87
57
169
121
61
55
59
161
171
201
189
195
79
127
37

10'
135
137
131
123
133
129
63
87
73
147
25
153
27
157
29
155
121
75
81
65
57
61
59
121
79
127
37
201
189
195

10'
23
19
127
131
25
143
163
165
123
125
187
159
21
161
77
199
14
191
14
185
55
153
33
193
189
195

LIGHTWEIGHT TABLE WITH UNITIZED TABLE TOP

FIELD OF THE INVENTION

This invention relates generally to articles of furniture and, more particularly, to tables, which are made of lightweight materials.

BACKGROUND OF THE INVENTION

Portable tables are often required by schools, churches, universities, convention centers, hotels, industry and private individuals for diverse purposes such as for food service, meetings, conferences, education and the like. Such tables must be rugged and able to withstand hard use and must be a good value. It is highly desirable for such tables to be made of lightweight materials so that they can be easily lifted by one or more persons and carried to the desired location, such as to a storage room or another use location.

Such portable tables typically have a generally planar table top member and a folding leg assembly. The table top member typically consists of a frame in combination with a table top surface. The folding leg assembly typically consists of two pairs of spaced apart outer legs. Each pair of legs is mounted so that the legs may be folded between a position in which the legs are retracted against the table bottom and a further position in which the legs are extended from the table to support the table on a surface, such as a floor surface.

While the known prior art includes many portable tables, those tables have a number of important disadvantages. For example, U.S. Pat. No. 5,694,865 (Raab), U.S. Pat. No. 5,868,081 (Raab) and U.S. Pat. No. 6,058,854 (Tarnay et al.) each describe tables having a table top with a reinforcement panel and interconnected frame structure. U.S. Pat. No. 5,947,037 (Hornberger et al.) describes a table having a table top which includes a multi-part frame having interlocking frame elements and corner pieces and further includes a lightweight core held in place by adhesive between upper and lower plastic shells. As is apparent, the structure of each table is complex and requires many interconnected parts. The numerous required parts are of complex construction unduly adding cost and complexity to the manufacturing process.

U.S. Pat. No. 5,394,808 (Dutro et al.) describes a table having a table top shell element filled with a porous hardened plastic foam. Strength and rigidity is provided by a complex array of conical regions and ribs formed in the shell. However, no separate internal reinforcing support structure is provided thereby limiting the structural integrity of the table.

Other tables, such as the tables of U.S. Pat. No. 4,951,576 (Cobos et al.), and U.S. Pat. No. 5,443,020 (Price), utilize support components made of wood. U.S. Pat. No. 5,271,338 (Bonham) requires a wood and plastic laminate top and an extensive support frame including peripheral and interior support beams. The structure of each table is complex. Components are required which add unnecessary weight, making the tables unduly difficult to transport.

A new table which would include a unitized table top providing structural integrity and durability, which would include a minimum number of parts, which would include less complex parts and which would be of lightweight construction would represent a notable advance in this field of technology.

OBJECTS OF THE INVENTION

It is an object of the invention to provide a table which overcomes certain problems and shortcomings of the prior art.

Another object of the invention is to provide a table with a unitized table top.

An additional object of the invention is to provide a table which is made of lightweight materials and is portable.

Yet another object of the invention is to provide a table in which the table components are of a simple design and structure.

A further object of the invention is to provide a table which is relatively economical to manufacture.

One additional object of the invention is to provide a table which is sturdy and rugged.

How these and other objects are accomplished will become apparent from the following descriptions and from the drawings.

SUMMARY OF THE INVENTION

The invention is a lightweight portable table including a unitized table top and leg structure for supporting the table top on a floor or other surface. The table may be used in any application where a sturdy and easily transportable table is desired. For example, the table may be used in schools, churches, universities, convention centers and hotels as well as in private residences.

In general, the unitized table top member consists of table top and bottom elements enclosing a rigid support member which is preferably a support rail. A hardened solid state foam body is formed around the rail in sufficient volume to support the rail within the table. A lightweight core element is disposed within the table and is joined to the hardened foam body. The hardened foam body, core and table top and bottom elements are joined together by adhesive into a single unit, i.e., the parts are unitized. The table structure is lightweight and sturdy yet avoids complexities and costs associated with the support structure of conventional tables.

The table top preferably includes a table top element and a table bottom element which are joined together in a fixed-position relationship to form the table top. The table top and bottom elements define a cavity between them in which structural components of the table top are contained. The unitized table top is not limited to any particular geometry and may be, for example, rectangular, round, octagonal or another type of polygon.

The preferred table top element has a generally planar top surface and a top periphery. The preferred table bottom element has a bottom surface, a bottom periphery and an apron depending from the bottom surface and extending adjacent the entire bottom periphery. Most preferably, the apron is spaced inwardly from the bottom member periphery and extends continuously around the bottom member bottom surface adjacent the bottom member periphery. The most preferred apron has first and second generally opposed side walls and a bottom wall therebetween. The walls defining the apron may be of any suitable configuration and need not be planar. Such walls need not be parallel to the other and could, for example, define an arcuately-shaped apron. The table top and bottom elements may be made of any suitable material including polyethylene, styrene, polypropylene and like materials. Acrylonitrile butadiene styrene ("ABS") is preferred.

Structural support is provided by a rigid support member, preferably in the form of a support rail, positioned in the apron and extending along the entire apron. The preferred rail functions as a joist permitting the table to be loaded and providing structural rigidity to the table. The most preferred rail is made of solid sheet material and has a thin ribbon-like appearance. Preferably, the rail has a height dimension greater than its thickness dimension. The elegant rail design minimizes weight while avoiding any requirement for interconnecting parts which fit one inside the other.

The support rail could comprise a single length of material formed to conform to the shape of the apron, for example in a round-shaped table. For rectangular tables in particular, it is preferred that the support rail is formed of plural rail elements. In such an embodiment the rail would include a pair of side rails and a pair of end rails. The ends of the rails are preferably arranged so that they overlap in side by side relationship with the adjacent rail element. As will be apparent, no fastener is required to hold any of the rail elements in place one to the other because the hardened foam body holds the rail elements in place.

A hardened foam body is provided within the table and is joined to the top and bottom table elements. As used herein, the term "hardened foam body" means or refers to a lightweight coherent solid state body having a plurality of void volumes, cells, interstices, or the like formed therein. The foam body is formed partially or fully around the rail. A sufficient volume of foam body material is provided to at least partially fill the apron to hold the rail in place therein. The foam body is provided with an inner edge surface defining a core-receiving space between the top and bottom elements within the cavity. The foam body is preferable made of a material such as urethane foam, polyethylene foam, expanded polystyrene and other expandable materials.

A core element is joined to the table top member through at least attachment to the foam body. The preferred core element is sized to fit within the core-receiving space and has an outer edge surface adjacent to and joined with the foam body inner edge surface. The preferred core element is made of a lightweight material and includes a plurality of cells with void volumes therein. Preferably, the core element has a top side in contact with the top member and a bottom side in contact with the bottom member. In such an embodiment, an adhesive is provided to join at least the core element top side to the top member. The core element may also be joined to the bottom element by means of the adhesive.

It is most preferred that the core comprises a honeycomb core element. The honeycomb core element has a plurality of generally vertically-oriented walls in a substantially regular geometric pattern defining the cells. Desirably, the vertical walls provide structural support for the table top member. The core element may be made of plastic, paperboard, extruded polystyrene or other suitable material.

The table top may optionally include corner elements to protect the corners from damage. In such embodiments, the table top has at least one corner and, preferably, four corners. The table bottom element is provided with a generally horizontal shelf between the apron and bottom element periphery and the corner element is positioned on the shelf around each table top corner. The corner element is held in place by the foam body which is formed around each such corner element. The most preferred type of corner element is a tube. It is preferred that each corner and corresponding bottom element flange and shelf have a radius and that the corner element has substantially the same radius thereby conforming the tube to the shelf and flange along each corner.

In a highly preferred embodiment, the hardened foam body and rail comprise a separate formed-together element, for example, made in a separate mold. In such embodiment, the foam body partially or fully encasing the rail is configured to conform to the apron and cavity portions about the apron and has an outer and upper surface abutting corresponding surfaces of the apron and table top element. An adhesive is applied along at least portions of the abutting foam body, apron and table top element surfaces. The adhesive joins these components together to form the unitized table top member. In this embodiment, the lightweight core element may either be formed integrally with the foam body or joined to the separately formed foam body by an adhesive.

In a most highly preferred embodiment, the foam body includes an integral adhesive and the foam body joins the rail to the table bottom element. In this embodiment, an upper surface is provided in the foam body. The upper surface abuts a corresponding table top element surface. The upper surface is held in place against the top surface by an adhesive. It is most highly preferred that the core element of this embodiment is held in place against the foam body by a separate adhesive. Other methods of manufacturing the table top member are within the scope of the invention.

It is most highly preferred that leg assemblies are secured to the table top member. In this embodiment, each assembly includes a pair of legs. The legs of each assembly are movable between a "use" position in which the legs are extended downwardly from the table to support the table on a floor or other surface and a "storage" position in which the legs are retracted against the table bottom surface permitting the table to be easily transported. It is envisioned that other types of supports may be used in conjunction with the table.

Attachment points for the leg assemblies may by provided in the form of brackets which easily clip onto the rails without the need for separate fasteners. Preferably two brackets are provided for each leg assembly and the brackets are secured to the rail in an opposed manner. A third leg attachment point for each assembly may also be provided, preferably in the form of a plate bonded to the table bottom element.

Further details regarding the invention are set forth in the following detailed descriptions and in the drawings.

BRIEF DESCRIPTIONS OF THE DRAWINGS

Figures 1, 2, 3:
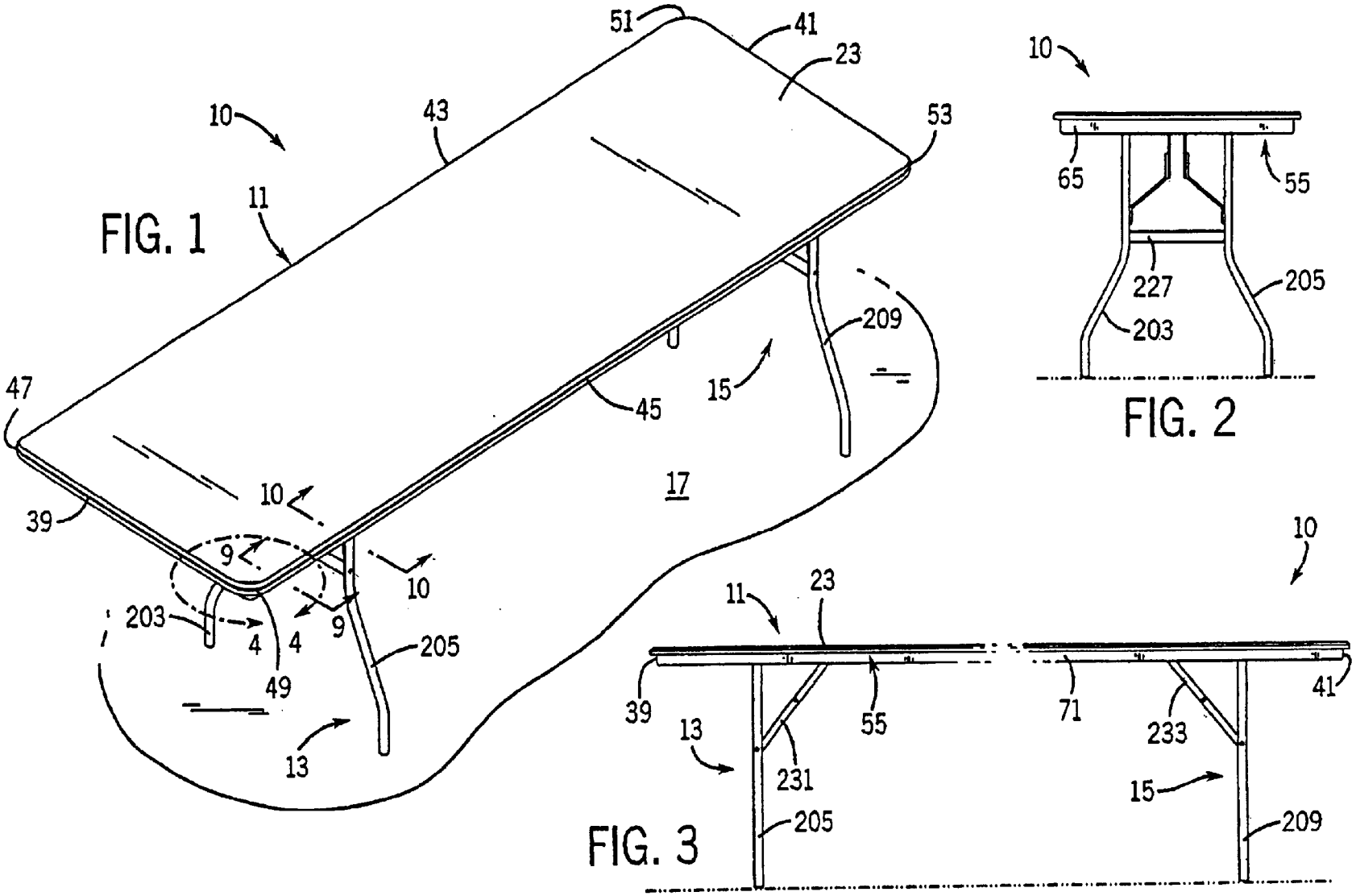
FIG. 1 is a perspective view of one embodiment of the table of the invention.
FIG. 2 is an end elevation view of the table of FIG. 1.

FIG. 3 is a side elevation view of the table of FIG. 1. The other side of the table is a mirror image of the side shown in FIG. 3. The dashed lines indicate that the exemplary rectangular table may be of any suitable length.

Figure 4:
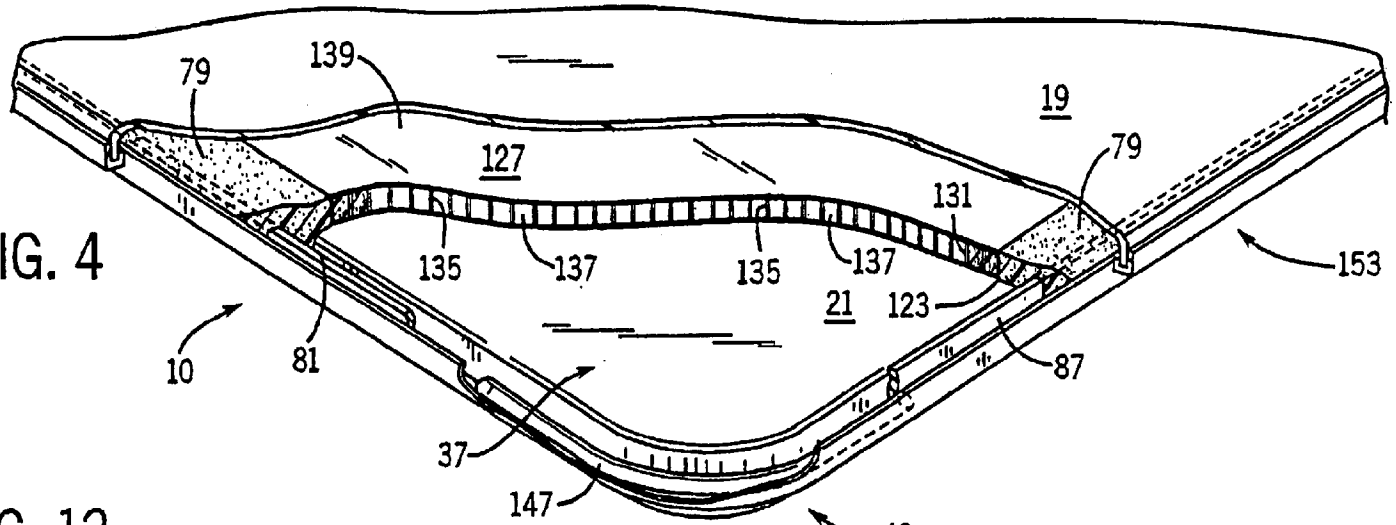

FIG. 4 is in enlarged partial perspective view of a corner of the table of FIG. 1 taken along section 4. Parts are cut away and certain hidden parts are shown with dashed lines.

Figure 5:
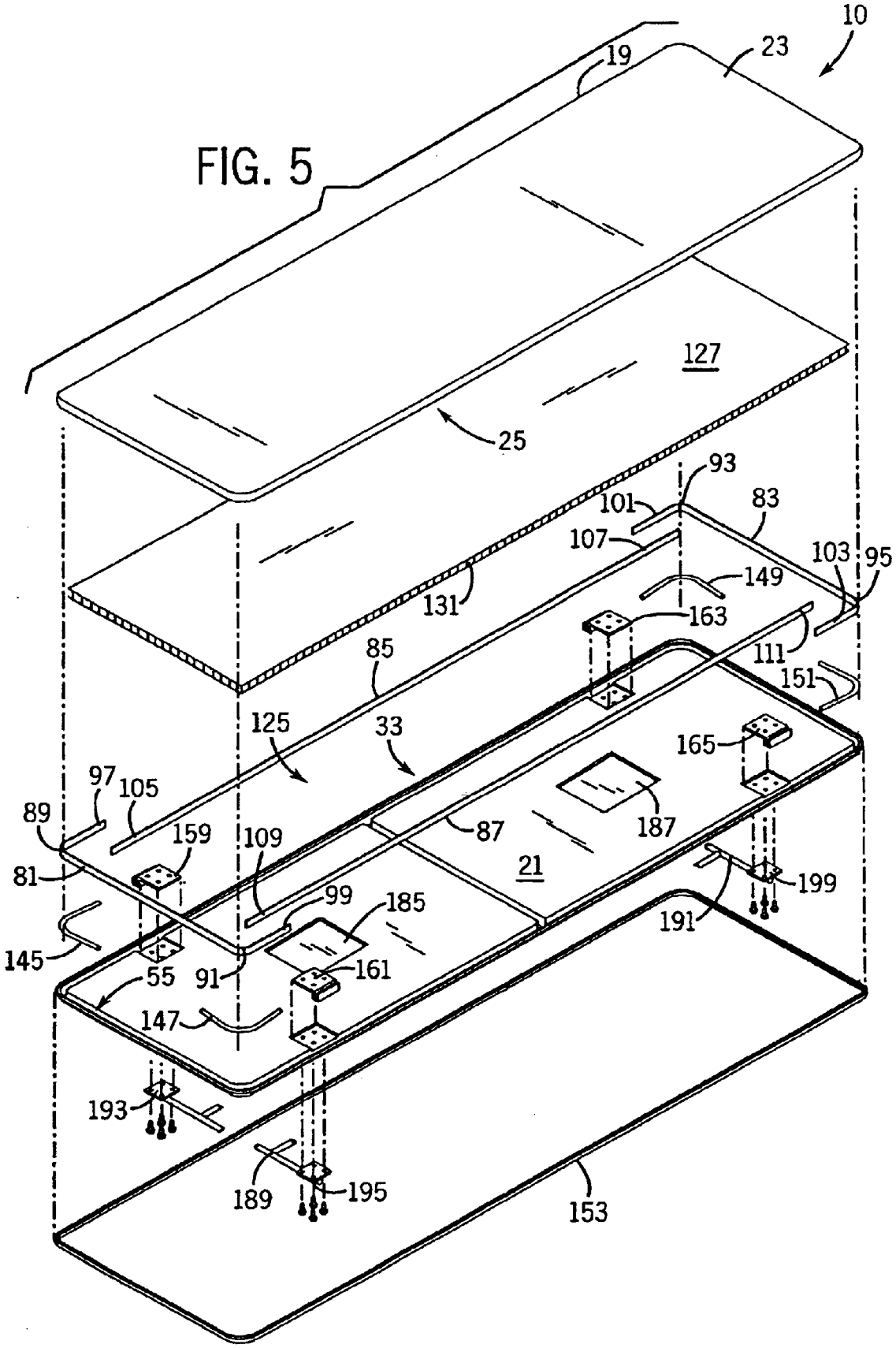

FIG. 5 is an exploded perspective view of the table top of the table of FIG. 1 not including the foam body material and certain other parts.

Figure 6:
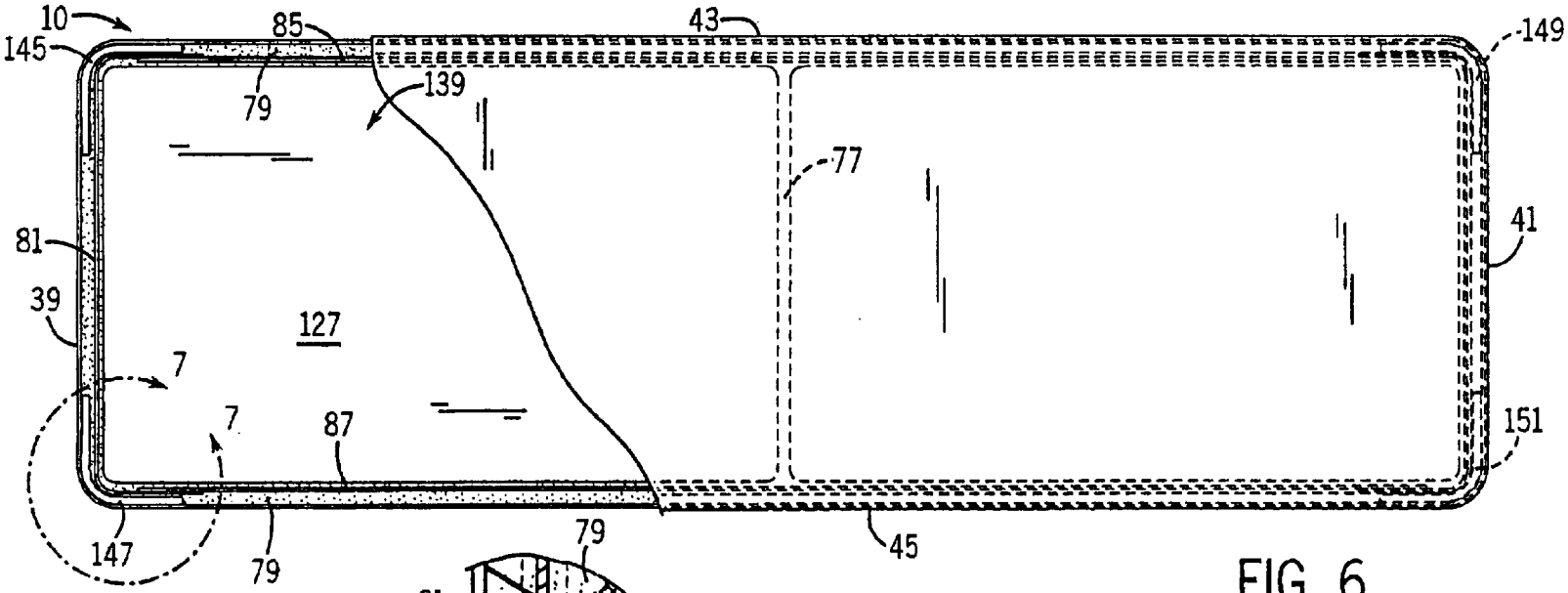

FIG. 6 is a top plan view of the table of FIG. 1. Parts are cut away and certain hidden parts are shown with dashed lines.

Figure 7:
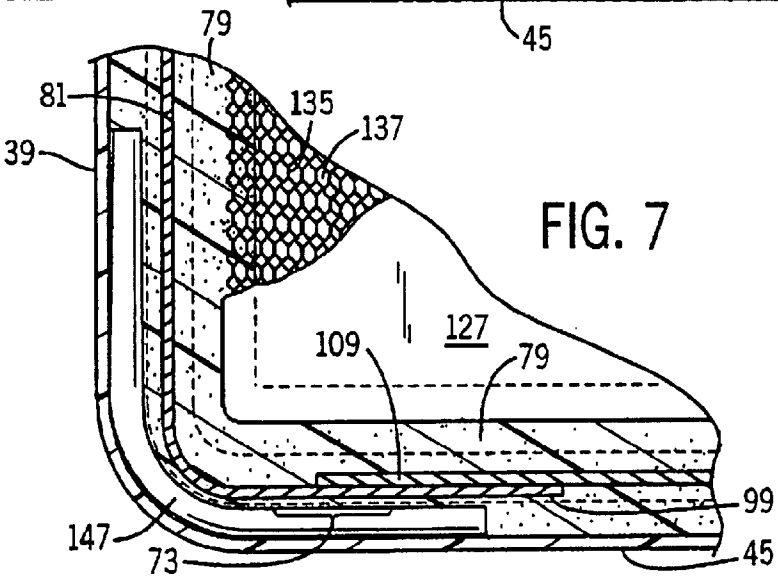

FIG. 7 is an enlarged partial top view of the table corner represented by section 7 of FIG. 6. Parts are cut away and certain hidden parts are shown with dashed lines.

Figure 8:
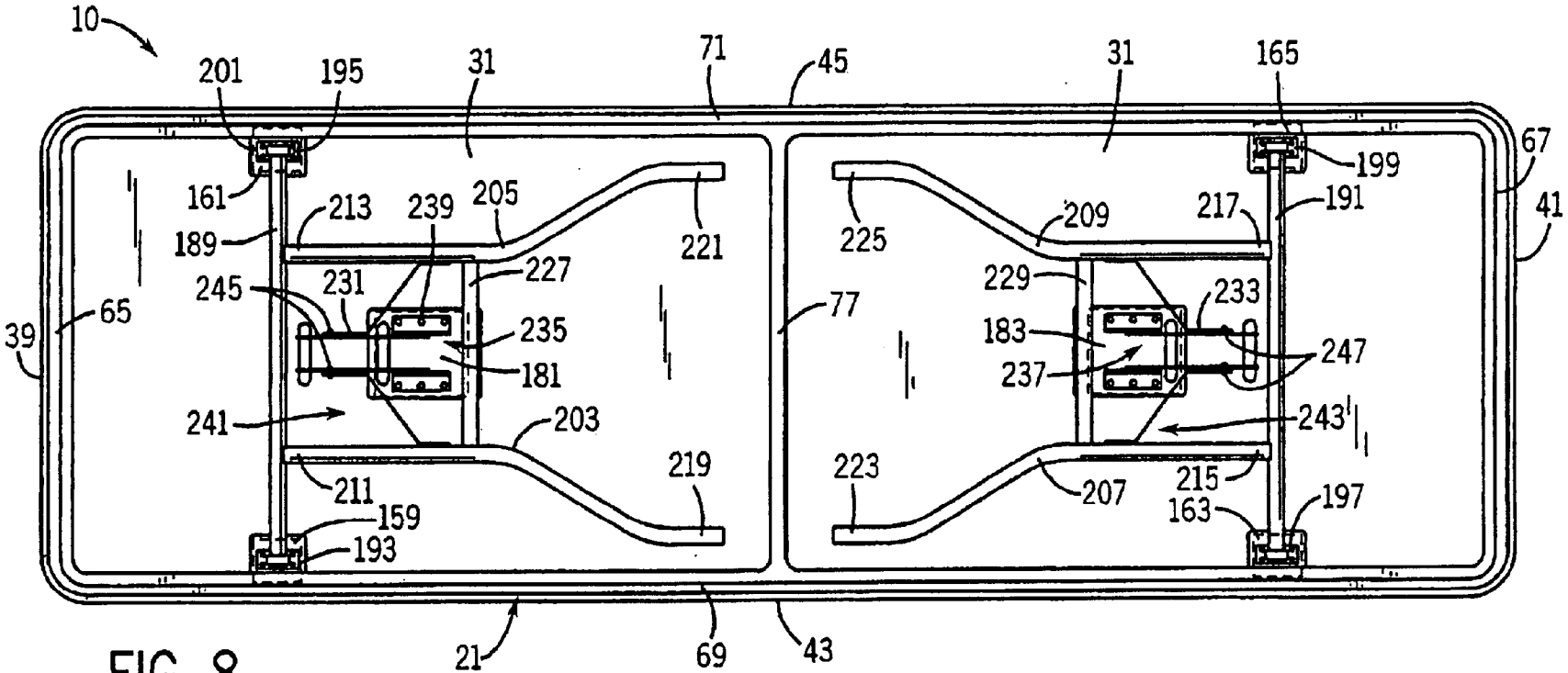

FIG. 8 is a bottom plan view of the table of FIG. 1. Certain hidden parts are shown with dashed lines.

Figure 9:
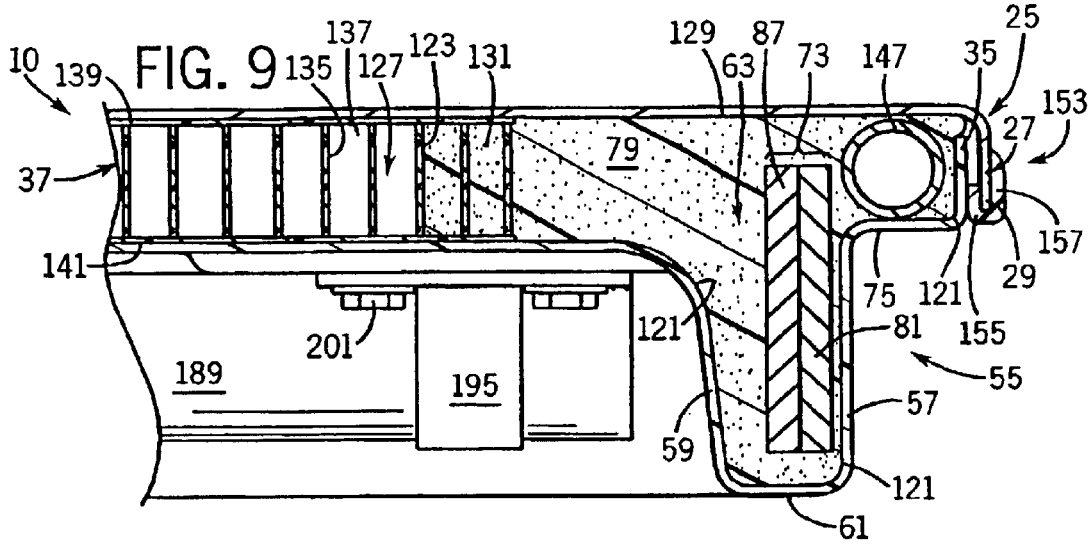

FIG. 9 is an enlarged partial sectional view taken along section 9—9 of FIG. 1.

Figure 10:
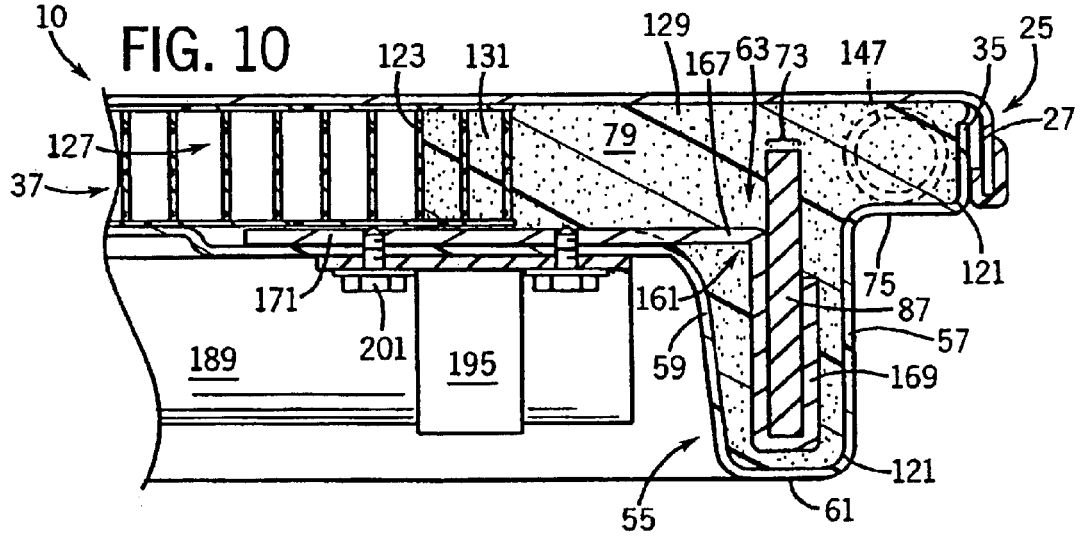

FIG. 10 is an enlarged partial sectional view taken along section 10—10 of FIG. 1. Certain hidden parts are shown with dashed lines.

Figure 11:
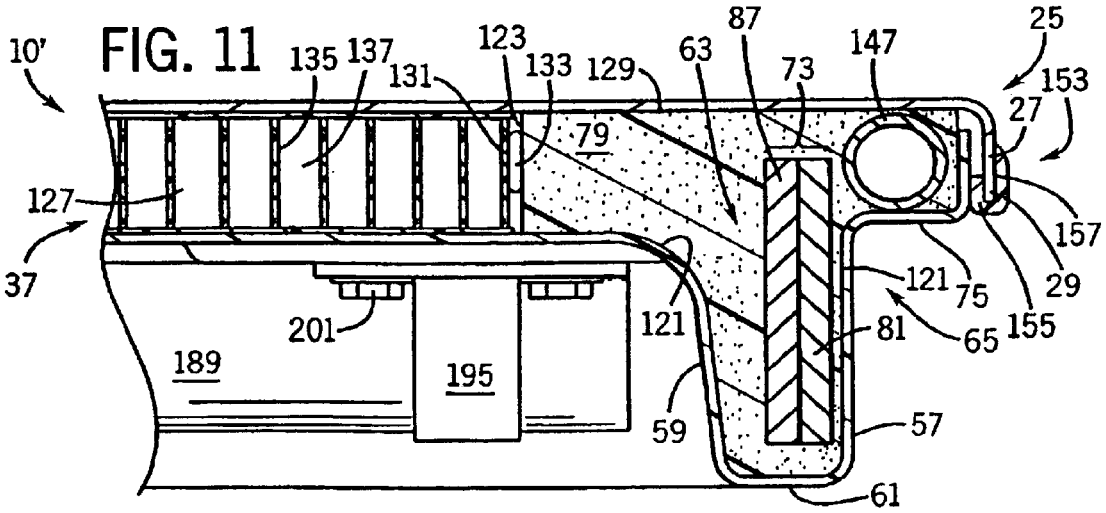

FIG. 11 is an enlarged partial sectional view of another embodiment of the table of the invention taken along a section, such as section 9—9 of FIG. 1.

Figure 12:
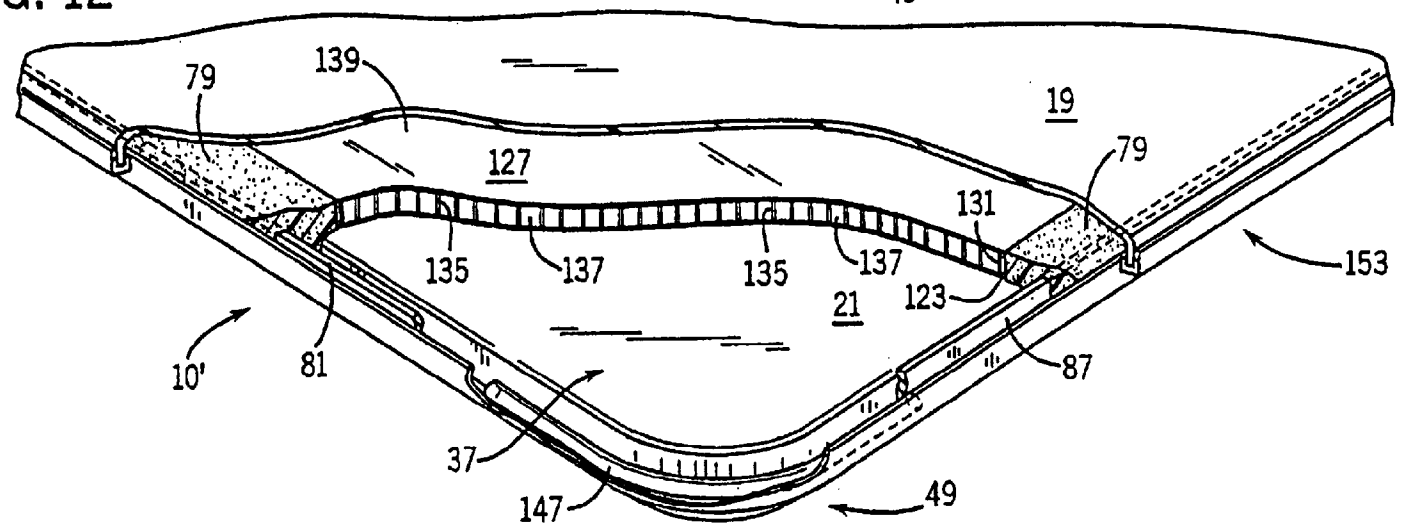

FIG. 12 is an enlarged partial perspective view of a corner of a table such as shown in FIG. 11 but taken along a section, such as section 4 of FIG. 1. Parts are cut away and certain hidden parts are shown with dashed lines.

Figure 13:
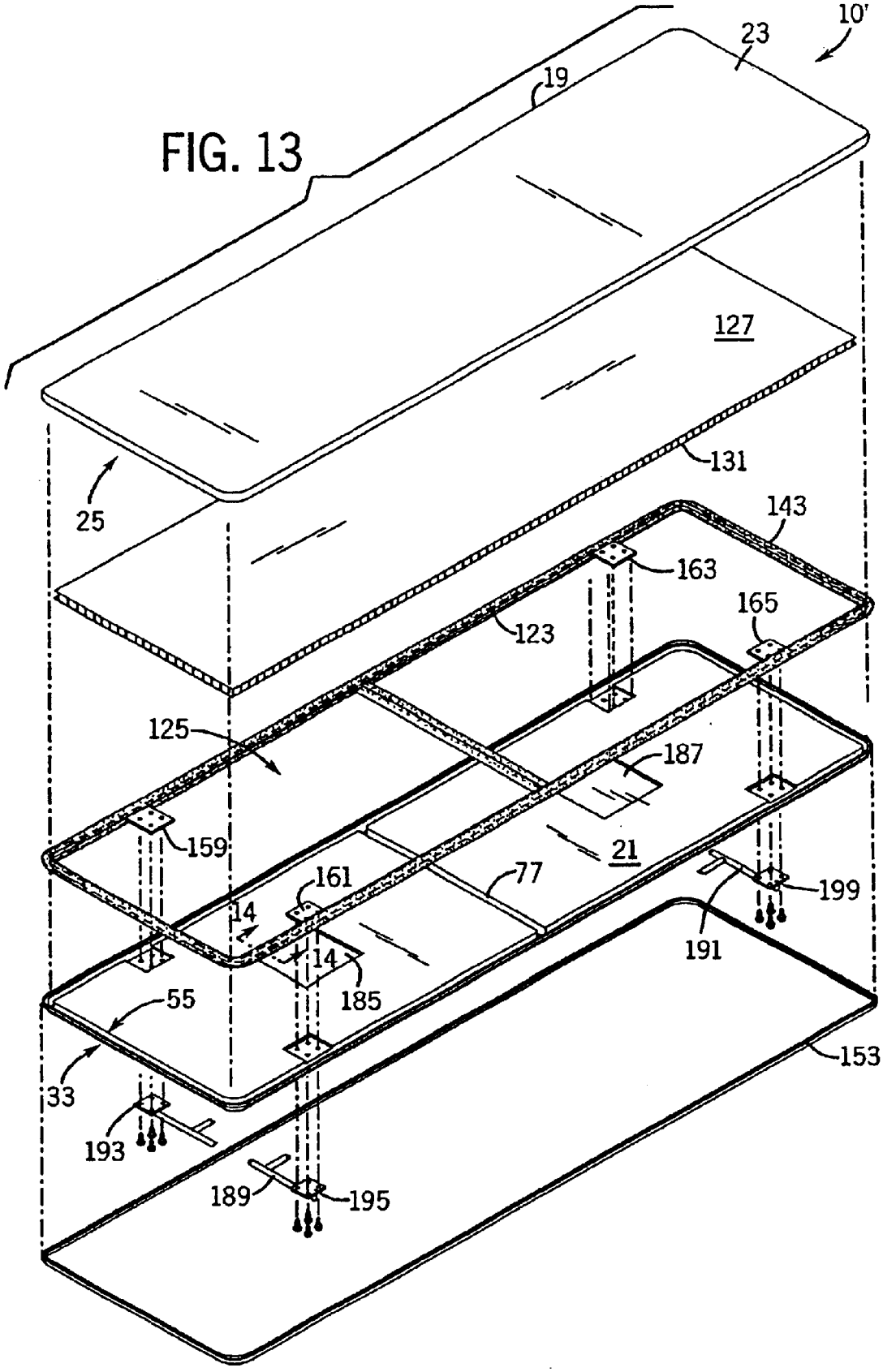

FIG. 13 is an exploded perspective view of the table top of an alternative embodiment of the invention. FIG. 13 includes a perspective view of a separately formed foam body and rail element.

Figure 14:
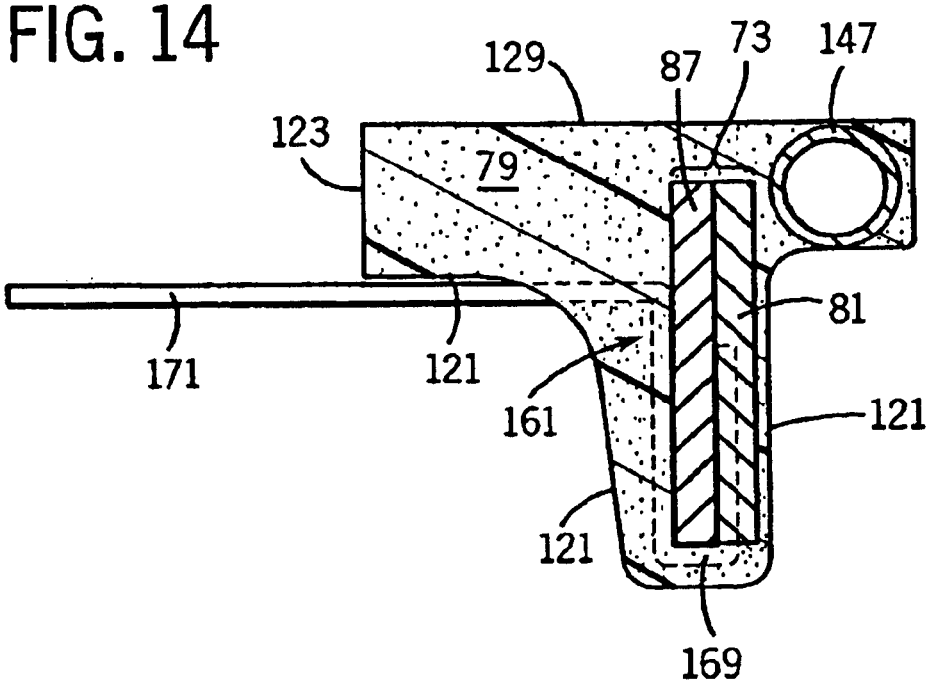

FIG. 14 is an enlarged partial sectional view of the separately formed foam body and rail element taken along section 14—14 of FIG. 13. Parts are broken away and certain hidden parts are shown with dashed lines.

DETAILED DESCRIPTIONS OF PREFERRED EMBODIMENTS

Preferred embodiments of invention will now be described with reference to FIGS. 1–14. As shown in these figures, exemplary lightweight table 10, 10' has a unitized table top member 11 and leg assemblies 13, 15. Leg assemblies 13, 15 are provided to support table 10 on a surface, such as a generally horizontally-oriented floor surface 17.

Table top member 11 includes a table top element 19 and a table bottom element 21. The table top element 19 has a generally planar top surface 23 and a periphery 25 around the entire table top element 19. As shown in FIGS. 9–11, the table top element 19 may include a downwardly extending flange 27 around periphery 25. Flange 27 terminates in a downwardly directed end 29.

Table bottom element 21 has a bottom surface 31 and a bottom periphery 33 around the entire table bottom element 21. Also as shown in FIGS. 9–11, table bottom element 21 may include an upwardly extending flange 35 around bottom periphery 33. This preferred arrangement permits the top and bottom elements 19, 21 to be mated together such that the bottom element flange 35 is received within the top element flange 27 in overlapping relationship. Joining together of the table top and bottom elements 19, 21 in fixed-position relationship as described in more detail below, forms a cavity 37 between table top and bottom elements 19, 21.

The generally rectangular table top member 11 of exemplary tables 10, 10' has opposed ends 39, 41 and sides 43, 45 and further includes corners 47–53. Table top member 11 of the invention is not, however, limited to any particular shape. It is intended that table top member 11 could be manufactured to have any suitable shape including, without limitation, oval, round, octagonal or square shapes.

As best illustrated in FIGS. 2–5 and 7–13, bottom element 21 is provided with an apron 55 depending from bottom surface 31 and extending adjacent the entire bottom periphery 33. Apron 55 preferably includes first and second generally opposed side walls 57, 59 and a bottom wall 61. Apron upper end 63 is open and in communication with cavity 37. Walls 57–61 may be of any suitable configuration and orientation.

It is desirable, but not required, for apron 55 to have the same general geometric shape as that of the table top member 11. In the examples of FIGS. 1–14, the table top member 111 and apron 55 have generally rectangular shapes when viewed from above or below the table 10, 10'. Apron 55 has opposed end portions 65, 67 and opposed side portions 69, 71. Such arrangement of apron 55 permits support rail 73 to be located in a generally co-extensive manner with table ends 39, 41 and sides 43, 45 thereby positioning rail 73 to support loads placed on table 10, 10' and to prevent table 10, 10' from warping.

Preferably, apron 55 is spaced inwardly from bottom member periphery 33 and extends continuously around table bottom element 21. In such embodiment, shelf 75 is located in bottom element 21 between apron 55 and bottom element periphery 33 and flange 35. Apron 55 may be provided with one or more centrally-located portions, such as portion 77, which may span across some or all of bottom surface 31 thereby providing additional structural support for the table top member 11.

Table top and bottom elements 19, 21 are preferably made of ABS although other materials, such as polyethylene, styrene, polypropylene may be used. Depending on the material selected, the table top and bottom elements can be vacuum formed, injection molded or molded in ways known to those of skill in the art. Suitable ABS material is available from Allen Plastics of Holland, Mich. It is envisioned that the generally planar top surface 23 could optionally be manufactured to include various indentations, walls or compartments to facilitate use of the table for specific applications, for example in gaming or in industry.

As shown in FIGS. 4–7 and 9–14, structural reinforcement of table 10, 10' is provided by preferred support rail 73 held in place in apron 55 by a solid state mass of hardened foam body material 79. The preferred rail 73 for use with rectangular table top member 11 consists of plural elements, such as end rails 81, 83 and side rails 85, 87. Each end rail 81, 83 includes corners 89–95 and ends 97–103. Each side rail 85, 87 includes ends 95–111. As best seen in FIGS. 5–7, 9, 11 and 13–14, end rails 81, 83 and side rails 85, 87 are positioned within respective apron end and side portions 65–71 with their adjacent ends (for example, ends 97, 105 and 103, 111) in overlapping, side by side abutting relationship. As described in more detail below, the end and side rails 81–87 are advantageously held in place in apron 55 without fasteners by the hardened foam body 79.

In other embodiments, the support rail 73 could consist of a single piece of material configured to fit within apron 55. Such a one-piece rail 73 has particular utility in connection with round tables. While neither preferred nor necessary, the end and side rails 81–87 could be secured one to the other through a welding process or by use of fasteners, such as bolts, screws or the like. Any such securing, however, would disadvantageously add unnecessary costs to the manufacture of table 10 or 10'.

Most preferably, each end and side rail 81–87 is made of thin, lightweight solid sheet stock material. As represented in FIG. 10, rails 81–77 each have a height dimension between top and bottom edges 113, 115 and a thickness dimension between outer and inner edges 117, 119 (FIG. 10). The height dimension is greater than the thickness dimension thereby facilitating loading of the rails 81–87 while minimizing weight. Rails 81–87 may optionally have a height sufficient to cause rails 81–87 to extend through apron upper end 63 and into cavity 37 as shown in FIGS. 9–11 and 14 or the rails 81–87 may be of a height such that the rails 81–87 are fully contained within apron 55.

Rail 73, and elements such as rails 81–87, are preferably made of solid sheet stock 6061 aluminum alloy available from Pennsylvania Steel Company of Emigsville, Pa. As an example only, for a rectangular table having a length of approximately six feet, it has been found that 6061 aluminum alloy sheet stock having a height of 1.5" and a thickness of 0.125" is satisfactory for supporting the table under normal loading conditions. The height and thickness of rail 73 will be adjusted based on the size and anticipated use of the table 10, 10'.

Referring further to FIGS. 4 and 6–14, rail 73 is fully or partially encased within apron 55 by hardened foam body 79. A sufficient volume of foam body 79 material is provided to partially or fully fill apron 55 thereby supporting rail 73 in apron 55 within walls 57, 59, table top element 21 and/or bottom surface 31 when foam body 79 is in the solid state. As shown in FIG. 13, foam body 79 may also be positioned in any centrally-located portions, such as portion 77. The material selected for the foam body 79 preferably has high strength and a low density with many void volumes, cells or interstices formed therein thereby minimizing weight. As is well shown in FIGS. 4, 9–11 and 13–14, the foam body 79 has the unique advantage of being conformable to the shape of the apron 55 (or portion 77) while at the same time rigidly supporting the fully or partially encased rail 73 thereby serving dual purposes of reinforcing the table 10, 10' and minimizing weight. The material selected for use in formation of the foam body 79, may initially be in a liquid state which expands during curing to form a solid state mass. Solid state expandable materials may also be used. The most highly preferred type of material for use as foam body 79 will include an integral adhesive. One material suitable for use as foam body 79 is two part prepoly-isocyanate urethane 8-pound foam available from Urethane Technology Corporation of Newburgh, N.Y.

Referring next to FIGS. 9–11 and 14, foam body 79 has an outer and upper surface 121, 129 conformed to apron walls 57, 59 and/or 61, cavity 37 adjacent apron 55 and top element 19. Foam body 79 has an inner edge surface 123 facing away from table bottom element periphery 33 and defining a core-receiving space 125 within cavity 37 between table top and bottom elements 19, 21. Core 127 is received within space 125. As shown in FIGS. 9–11, foam body upper edge surface 129 abuts and is joined to table top element 19.

Core 127 is provided to add further structural support to table top member 11. Core 127 is sized to fit across core-receiving space 125 in cavity 37 between table top and bottom elements 19, 21. Core 127 has an outer edge 131 either integrally in contact with inner edge surface 123 (FIGS. 4, 7, 9–10) or closely adjacent to the inner edge surface 123 and held in contact with foam body 79 by adhesive 133 (FIGS. 11–12). As shown in embodiment 10 of FIGS. 4 and 9–10, inner edge surface 123 may be irregular along its interface with core 127. Alternatively, and as shown in embodiment 10' of FIGS. 11–12, the inner edge surface 123 may have a smooth regular surface formed by a mold dam during expansion and curing.

Preferably, core 127 has a plurality of generally vertically-oriented walls, such as walls 135. The walls (i.e., walls 135) in effect define cells enclosing void volumes, such as illustrative void volume 137. The combination of generally vertically-oriented walls 135 and void volumes 137 is highly preferred because such structure provides structural rigidity while minimizing weight. Core 127 may be of a "honeycomb" design meaning that the walls (i.e., walls 135) of the core 127 are arranged in a regular geometric pattern such as triangles, hexagons or the like. Alternative core designs may be utilized. Core 127 preferably includes top and bottom side paperboard sheets 139, 141 bonded across respective top and bottom sides of the core 127. Pressure sensitive adhesive (not shown) applied to the top and bottom sheets 139, 141 and in contact with respective portions of the table top and bottom elements 19, 21 bonds those elements together. Hexacomb brand material from Pactiv Corporation of Lake Forest, Ill. is a core 127 material suitable for use with table 10, 10'. Other types of lightweight materials, such as polyurethane or extruded polystyrene may be used for core 127. The walls 135 defining cells with void volumes 137 of such material are irregular. Hot melt pressure sensitive adhesive from Evans Adhesives of Columbus, Ohio is a suitable adhesive.

As described in the Methods section below, the material comprising foam body 79 can be introduced to table top member 11 in several preferred alternative methods consistent with the invention. For example, the foam body 79 and rail 73 may be made as a separate element 143 (FIGS. 13–14) which is made separately and conformed to the shape of apron 55 and cavity 37 adjacent apron with outer surface 121 abutting some or all of walls 57–61 and top surface 129 abutting top element 19. Such element 143 is bonded to the table top and bottom elements 19, 21 within cavity 37 and apron 55 by means of hot melt or other suitable adhesive.

By way of further example, foam body 79 and rail 73 may be formed together directly in the apron 55 of bottom element 21. Integral adhesive in the foam body 79 permanently joins the foam body 79 and bottom element 21 together. Top element 19 is then bonded in place to the upper edge 129 of foam body outer surface 121 with a separate hot melt adhesive to join the table top and bottom elements 19, 21. Core 127 may be formed integrally with foam body 79 (FIGS. 4, 6–7, 9–10) or may be separately bonded to foam body inner edge 123 with a separate adhesive 133 (FIGS. 11, 12).

Referring to FIGS. 4–7 and 9–14, corner elements 145–151 may optionally be provided to reinforce corners 47–53 of table top member 11 thereby protecting the table 10, 10' from damage caused by contact with walls and other objects. Corner elements 145–151 are located on shelf 75 between apron 55 and bottom flange 35 and peripheries 25, 33. Corners 47–53 and bottom flange 35 around said corners are preferably rounded and have a radius. Corner elements 145–151 have a corresponding radius ensuring proper fit along each corner 47–53. The hardened foam body 79 encases corner elements 145–151 sufficiently to hold such elements in place with the unitized table top 11.

Corner elements 145–151 may be made of steel tube or other suitable material. By way of example only, corner elements 145–151 may be fabricated from 0.625" OD ×0.052" wall welded steel tubing. For an exemplary 6' table, corner elements 145–151 may be cut to approximately 11" long lengths in a cutting die and bent at an 85° angle in a forming die. Such curvature of corner elements 145–151 approximates the radius along the bottom flange 35 at corners 47–53.

A protective guard element 153 may optionally be provided along table sides, ends and corners 39–53. Guard element 153 further protects top member 11 from damage. As best shown in FIGS. 9–11, guard element 1.53 includes a pocket 155 fitted over top flange end 29. A guard wall 157 extending from pocket 155 extends over at least a portion of top flange 27 along table sides, ends and corners 39–53. The guard element 153 may be made of any suitable material, such as extruded plastic.

Another aspect of the invention is the optional brackets 159–165 provided as attachment points for leg assemblies 13, 15. Brackets 159–165 are secured to respective side rails 85, 87 without the need for mechanical fasteners or complex extruded parts. As shown in FIGS. 5, 8, 10 and 13–14, a preferred form of bracket 159–165 has a generally L-shaped body 167 with a clip 169 formed at one end and a flat leg attachment portion 171 between the clip 169 and other end. Clip 169 fits tightly against rail bottom edge 115 and inner and outer edges 117, 119 without fasteners. Flat leg attachment 171 portion is generally parallel to, and abuts bottom element bottom surface 31 within protrusions 173–179. Hot melt adhesive (not shown) may optionally be applied on protrusions 173–179 to bond brackets 159–165 to bottom element 21.

Preferably, brackets 159–165 are positioned as shown in FIGS. 5, 8, 10 and 13 with each member of each bracket pair 159, 161 and 163, 165 mounted on a separate rail 85, 87 across from one another. Each clip 169 is secured around the respective rail 85, 87 before introduction of the foam forming the hardened foam body 79. Where a separately formed foam body and rail element 143 is provided, the brackets 159–165 are formed as part of the element 143 (FIGS. 13–14). Foam body 79 holds brackets 159–165 in place within table top member 11.

By way of example only and for a six foot rectangular table, brackets 159–165 may be made of 0.062" hot-rolled steel blanks available from Pennsylvania Steel Company. The brackets 159–165 are stamped in a 15-ton press to form the desired body 167, clip 169, and attachment portion 171. The actual bracket size will vary to accommodate tables of different shapes and sizes.

As is well shown in FIG. 8, plates 181, 183 are optionally provided as a third attachment point for each leg assembly 13, 15. Each plate 181, 183 is preferably flat and is bonded by hot melt adhesive or the like (not shown) within protrusions 185, 187 (FIGS. 5 and 13) formed in bottom surface 31. By way of example, plates 181, 183 may consist of 5"×7"×0.062" hot rolled steel plates.

The structure of exemplary folding leg assemblies 13, 15 will now be described with reference to FIGS. 1–3, 5, 8–11 and 13. Each assembly 13, 15 includes a tube 189, 191 secured for back-and-forth rotating movement to brackets 159, 161 or 163, 165 by turtle clips 193–199. Turtle clips 193–199 are secured to a respective bracket 159–165, preferably by four self-tapping, self-drilling hex head screws of which screw 201 is representative.

Two legs 203, 205 or 207, 209 are welded at a respective upper end 211–217 to a respective tube 189, 191. Lower ends 219–225 are provided for contact with floor surface 17 when in the extended "use" position shown in FIGS. 1–3. Horizontal braces 227, 229 provide lateral support for legs 203–209. Folding braces 231, 233 each have an upper end 235, 237 secured to a respective plate 181, 183 by six self-tapping self-drilling hex head screws of which screw 239 is exemplary. Brace lower ends 241, 243 are pivotally secured to respective legs 203–209. Hinges 245, 247 permit braces 231, 233 to be extended and retracted. Legs 203–209 may be folded or pivoted between the extended "use" position shown in FIGS. 1–3 and the retracted "storage" position shown in FIG. 8. Braces 241, 243 lock each leg assembly 13, 15 in place when in the extended "use" position.

Methods of Manufacture

Preferred methods for manufacturing exemplary table top members according to the invention will now be described. The methods will be described in connection with the manufacture of exemplary rectangular table 10, 10'. In one preferred method, the hardened foam body 79 and rail 73 may be manufactured as a separate formed-together element 143 as shown in FIGS. 13–14. The hardened foam body 79 encasing rail 73 is subsequently joined to the table top and bottom elements 19, 21 with a hot melt adhesive or other suitable adhesive to form the unitized table top 11. Core 127 may be provided as an integral component of foam body 79 or may be bonded to the foam body 79 with adhesive in a separate step.

According to a preferred first method, a custom mold replicating the table top and bottom elements 19, 21 cavity 37 and apron 55 is first manufactured. The mold shapes foam body 79 outer surface 121 and top edge surface 129 to conform to the shape of these elements. A hinged top lid held in place by Destco clamps may be provided to access the mold cavity. A dam may be provided to form inner edge surface 123 in foam body 79 if core 127 is to be added in a separate step and is not provided as an integral portion of foam body 79. The mold is housed in a steel frame to resist forces applied by the expanding foam.

Preferably, a release liner comprising 0.001" plastic sheet material is stretched across the bottom of the mold cavity. The release liner is provided to protect the mold and permit the foam body 79 to be released from the mold following hardening of the foam body 79.

Next, brackets 159–165 are secured to a respective side rail 85, 87 in the positions shown in FIG. 8. The clip 169 of each bracket 159–165 is fitted around the appropriate side rail 85, 87. The side rails 85, 87 are then placed in the mold with the brackets 159–165 supporting side rails 85, 87 in an upright position. End rails 81, 83 are set into position within the mold so that the ends (for example, ends 97, 105 and 103, 111) overlap and abut one another. Small urethane blocks (not shown) may be used as wedges to center the rails 81–87 in the mold cavity corresponding to apron 55. Corner elements 145–151 are optionally positioned in those portions of the mold corresponding to the table corners 47–53 and shelf 75. Core 127 is placed inside the mold cavity within rails 81–87 in core-receiving space 125 if it is to be integrally formed with the foam body 79.

In the next step, the material comprising foam body 79 is introduced to the mold. The process will be described for use in connection with the highly preferred two part prepolyisocyanate urethane 8-pound foam. The urethane is first mixed in a Decker "High Pressure" mixer. The mixer meters together the two components comprising the urethane and mixes them by injecting each into the other at high pressure. A timed shot of urethane material is evenly distributed into that portion of the mold cavity representing the apron 55 through the open lid. The volume of urethane used will vary based on the size and other requirements of the table but is of sufficient amount to support rails 81–87. The lid is closed and clamped in place. The foam is allowed to expand and cure for about 10 to 15 minutes at room temperature (i.e., about 23° C.).

If core 127 is in place, the inner edge surface 123 of foam body 79 will expand into contact with, and become bonded to, outer edge surface 129 of core 127. Otherwise, the dam prevents further inward expansion of the foam to form inner edge surface 123 (FIG. 11).

After curing, the clamps are released and the mold lid opened. The foam body 79 is in a hardened solid state. Foam body 79 and encased rail 73 element 143 is removed from the mold and stripped of the plastic release liner which is bonded to the foam body by the integral adhesive of the urethane. Urethane flash is removed from the foam body 79 prior to final assembly.

Next, plates 181, 183 are placed into protrusions 185, 187 along the table bottom element 21 bottom surface 31 and are bonded in place with adhesive, such as hot melt adhesive. The foam body 79 is next positioned in table bottom element 21 as shown in FIG. 13 and is bonded in place with adhesive along foam body outer surface 121. If core 127 is supplied as a discrete component, the hot melt adhesive is next sprayed on table bottom element 19 within core-receiving space 125. Adhesive 133 is then applied along element inner edge surface 123 and core outer edge 131 and core 127 is set in place within bottom element 19 (FIGS. 11–12).

Hot melt adhesive is then sprayed across the top surface 129, 139 of the assembly. The table top element 19 is then carefully placed on the assembly and lightly pressed down by hand. The fully assembled table top member 11 is then slid into a custom vacuum press. The vacuum press clamps the table top member 11 for approximately 10–20 minutes to complete assembly of table top member 11.

In an alternative method of manufacture, foam body 79 and rail 73 may be formed in place directly within table bottom element 21. Core 127 may be formed as an integral component of foam body 79 or, more preferably, is bonded to the foam body 79 in a separate step with a separate adhesive 133.

According to this alternative process, table bottom element 21 is placed in a custom mold replicating the table top element 19 and portions of cavity 37 adjacent apron 55 formed between the top and bottom elements 19, 21. Bottom element 21 and mold shapes foam body 79 to conform to the shape of these elements as the foam material expands and cures. A hinged top lid held in place by Destco clamps may be provided to access the mold cavity, A dam is provided to form inner edge surface 123 (i e., as in FIG. 11) in foam body 79 if core 117 is not to be formed as an integral portion of foam body 79. Again, the mold is housed in a steel frame to resist forces 110 applied by the expanding foam.

Brackets 159–165 are secured to a respective side rail 85, 87 and the rails 81–87 are set into position within apron 55. Each bracket attachment portion 171 may be bonded in protrusion 173–179 with hot melt adhesive or the like. Optional corner elements 145–151 are also set into position. The manner of placement of these components is identical to that of the previous method except that the components are located directly within the table bottom portion 21 and apron 55 rather than the mold. A release liner is not required because the foam body 79 is formed directly in the table bottom element 21 and bonds to that element due to the integral adhesive in the foam body material. Once again, small urethane blocks (not shown) may be used as wedges to center the rails 81–87 in the apron 55 of table bottom portion 21. If core 127 is to be formed integrally with foam body 79, then plates 181, 183 are bonded in place in protrusions 185, 187 with hot melt adhesive. Core 127 may then be positioned in the core-receiving space 125 and bottom side 141 glued to bottom element 21 within rails 81–87.

In the next step, the material comprising foam body 79 is introduced directly into apron 55. As with the previous method, two part prepoly-isocyanate urethane 8-pound foam is the preferred material for use in making foam body 79. The urethane is mixed, applied, expanded and cured as in the previous method with the volume of urethane used being controlled based on the size and other requirements of the table provided that a sufficient volume of foam material is provided to support rails 81–87 within table bottom element 21 and apron 55. The integral adhesive of the urethane foam bonds the foam body 79 in place to the table bottom element 21.

If core 127 is to be formed integrally with foam body 79, the inner edge surface 123 of foam body 79 will expand into contact with, and become bonded to, outer edge surface 131 of core 127. If the core 127 is to be introduced in a separate step, the provided dam prevents further inward expansion of the foam to form a smooth inner edge surface 123 (i.e., as in FIGS. 11, 14).

After curing and opening of the mold, any unwanted urethane flash is removed. If the core 127 is to be introduced separately, plates 181, 183 and core 127 are then positioned and bonded in table bottom element 21 in a manner identical to that of the previous method. The table top element 19 is then carefully placed on the assembly and lightly pressed down by hand. The fully assembled table top member 11 is then slid into a custom vacuum press. The vacuum press clamps the table top member 11 for approximately 10–20 minutes to complete assembly of table top member 11.

The leg assemblies 13, 15 are attached to each table top member 11 as described above to complete the manufacturing process.

It is envisioned that other manufacturing processes may be utilized in manufacturing the table 10. For example, the table top member 11 could be manufactured in a single step. In such a process, the table top and bottom elements 19, 21, core 127, rail 73, brackets 159–165, plates 181, 183 would be assembled as described above. Liquid state urethane foam would then be introduced into the apron 55 of table top member 11 through a plurality of ports. The foam would be allowed to expand and cure (with the table top member 11 secured by clamps) into the solid state hardened foam body 79, in the process joining the parts into a unitized table top member 11.

While the principles of the invention have been shown and described in connection with preferred embodiments and methods, it is to be understood clearly that such embodiments and methods are by way of example and are not limiting.

What is claimed is:

1. A lightweight, portable table comprising:

a unitized table top member comprising:

a table top element having a generally planar top surface and a top periphery;

a table bottom element having a bottom surface, a bottom periphery and a rail-receiving apron depending from the bottom surface and extending adjacent the bottom periphery, said top and bottom elements being joined in fixed-positioned relationship to form a cavity therebetween;

a support rail in the apron;

a hardened foam body joined to the table top and bottom elements, said foam body being formed around substantially all of the rail and being of sufficient volume to at least partially fill the apron to hold the rail in place therein, said foam body having an inner edge defining a core-receiving space within the cavity;

a core element sized to fit within the core-receiving space and having an outer edge adjacent to and joined with the foam body inner edge, said core element being made of a lightweight material and including plural cells defining void volumes; and plural legs secured to the table top member, said legs being movable between a first position in which the legs are retracted under the table and a second position in which the legs are extended downwardly from the table to support the table on a surface.

2. The table of claim 1 wherein the apron is spaced inwardly from the bottom periphery, extends continuously around the bottom surface adjacent the bottom periphery and comprises first and second generally opposed side walls and a bottom wall therebetween.

3. The table of claim 2 wherein the rail is comprised of plural rail elements and, wherein:

the elements are made of a lightweight solid metal material and have ends, a height dimension and a thickness dimension, the height dimension being greater than the thickness dimension; and the elements are arranged in the apron one after the other with adjacent ends positioned in overlapping side by side relationship, said overlapping ends being held in place in the apron by the foam body.

4. The table of claim 2 wherein:

the table top member has corners;

the table bottom element includes a substantially horizontal shelf between the apron and bottom periphery along each corner;

a corner element is positioned on the shelf along each corner; and the foam body is formed around each corner element and joins each corner element to the table top member.

5. The table of claim 1 wherein the core element comprises a honeycomb core element having a plurality of vertical walls in a substantially regular geometric pattern defining the cells.

6. The table of claim 1 wherein the foam body is a material selected from the group consisting of urethane foam, polyethylene foam and expanded polystyrene.

7. The table of claim 1 wherein the foam body includes an integral adhesive in contact with the core element and table top and bottom elements and the adhesive joins the core element and table top and bottom table elements together to form the table top member.

8. The table of claim 1 wherein the foam body and rail comprise a separate formed-together element and, wherein:

the foam body and rail element has an outer surface configured to conform to the apron and cavity, said outer surface abutting corresponding surfaces of the apron and table top element; and an adhesive is on at least portions of the abutting surfaces, said adhesive joining the foam body and rail element and the table top and bottom elements to form the table top member.

9. The table of claim 8 wherein the foam body includes an integral adhesive in contact with the core element and the integral adhesive joins the core element to the foam body and rail element along the foam body inner edge and core element outer edge.

10. The table of claim 8 further including an adhesive along the foam body inner edge and core element outer edge and the adhesive joins the core element to the foam body and rail element.

11. The table of claim 1 wherein the foam body includes an integral adhesive and the foam body joins the rail to the table bottom element and the table further includes:

an upper surface provided in the foam body, said upper surface abutting a corresponding table top element surface; and an adhesive on the abutting foam body and table top surfaces, said adhesive joining the foam body and table top element to form the table top member.

12. The table of claim 11 further including an adhesive along the foam body inner edge and core element outer edge and the adhesive joins the core element to the foam body.

13. The table of claim 1 further including opposed brackets each forming an attachment point for securing at least one of the legs to the table top member, each bracket comprising:

a generally L-shaped body with first and second ends;

a rail-receiving clip formed in the body along the first end, said clip comprising opposed side walls and a bottom wall configured for attachment around a rail without fasteners; and a leg attachment region comprising a flat portion between the clip and second end and generally parallel to the table bottom element.

14. A lightweight, portable table of the type including a table top member and a pair of leg assemblies secured to a bottom side of the table top member, said leg assemblies including legs movable between a storage position in which the legs are retracted under the table and a use position in which the legs are extended downwardly from the table to support the table on a surface, the improvement wherein the table top member comprises:

a table top element having a substantially planar top surface and a top periphery;

a table bottom element having a bottom surface, a bottom periphery, a continuous rail-receiving apron depending from the bottom surface spaced inward from the bottom periphery along the entire periphery, said apron having first and second generally opposed side walls, a bottom wall therebetween and an open upper end, said top and bottom elements configured for mating engagement to form a core-receiving cavity therebetween, said cavity being in communication with the apron open end;

a support rail in and extending along the entire apron;

a hardened foam body joined to the table top and bottom elements, said foam body being formed around substantially all of the rail and being of sufficient volume to at least partially fill the apron to hold the rail in place therein, said foam body being provided with an inner edge defining a core-receiving space within the cavity; and a core element sized to extend across the core-receiving space between the top and bottom elements and having an outer edge adjacent to and joined with the foam body inner edge, said core element being made of a lightweight material and including a plurality of vertical walls in a substantially regular geometric pattern defining cells having void volumes.

15. The table of claim 14 wherein, the table top member has corners;

the table bottom element includes a substantially horizontal shelf between the apron and bottom periphery along each corner;

a corner element is positioned on the shelf along each corner; and the foam body is formed around each corner element and joins each corner element to the table top member.

16. The table of claim 14 wherein the foam body is a material selected from the group consisting of urethane foam, polyethylene foam and expanded polystyrene.

17. The table of claim 14 wherein the foam body includes an integral adhesive in contact with the core element and table top and bottom elements and the adhesive joins the core element and table top and bottom table elements together to form the table top member.

18. The table of claim 14 wherein the foam body and rail comprise a separate formed-together element and, wherein:

the foam body and rail element has an outer surface configured to conform to the apron and cavity, said outer surface abutting corresponding surfaces of the apron and table top element; and an adhesive is on at least portions of the abutting surfaces, said adhesive joining the foam body and rail element, and the table top and bottom elements to form the table top member.

19. The table of claim 18 wherein the foam body includes an integral adhesive in contact with the core element and the integral adhesive joins the core element to the foam body and rail element along the foam body inner edge and the core element outer edge.

20. The table of claim 18 further including an adhesive along the foam body inner edge and core element outer edge and the adhesive joins the core element to the foam body and rail element.

21. The table of claim 14 wherein the foam body includes an integral adhesive and the foam body joins the rail to the table bottom element and the table further includes:

an upper surface provided in the foam body, said upper surface abutting a corresponding table top element surface; and an adhesive on the abutting foam body and table top surfaces, said adhesive joining the foam body and table top element to form the table top member.

22. The table of claim 21 further including an adhesive along the foam body inner edge and core element outer edge and the adhesive joins the core element to the foam body.

23. The table of claim 14 further including opposed brackets each forming an attachment point for securing at least one of the leg assembly pairs to the table top member, each bracket comprising:

a generally L-shaped body with first and second ends;

a rail-receiving clip formed in the body along the first end, said clip comprising opposed side walls and a bottom wall configured for attachment around a rail without fasteners; and a leg attachment region comprising a flat portion between the clip and second end and generally parallel to the table bottom element.

24. In a lightweight, portable table including a unitized table top member and legs secured thereto, the improvement wherein the table top member comprises:

a substantially planar table top element;

a table bottom element, the table top and bottom elements forming a cavity therebetween and a table top member periphery, an apron depending from the table bottom element and extending adjacent the periphery, said apron forming a portion of the cavity;

a rigid support member in the cavity and apron;

a hardened foam body which (1) Ms an inner edge, (2) is joined to the table top and bottom elements, and (3) is positioned at least partially around the support member and is of sufficient volume to at least partially fill the apron to hold the support member in place therein; and a core element joined to the table top member within the cavity in a core-receiving space defined by the table top and bottom elements and the inner edge.

25. The table of claim 24 wherein the foam body is a material selected from the group consisting of urethane foam, polyethylene foam and expanded polystyrene.

26. The table of claim 24 wherein the core element has an outer edge around the core element and the outer edge is joined to the foam body inner edge.

27. The table of claim 26 wherein the core element is made of a lightweight material and includes plural cells defining void volumes.

28. The table of claim 27 wherein the core element comprises a honeycomb core element having a plurality of vertical walls in a substantially regular geometric pattern defining the cells.

29. The table of claim 24 wherein the support member:

is made of a lightweight solid metal material; and has a height dimension and a thickness dimension, the height dimension being greater than the thickness dimension.

30. The table of claim 29 wherein:

the support member comprises plural elements each having ends; and the elements are arranged in the apron one after the other with adjacent ends positioned in overlapping side by side relationship, said overlapping ends being held in place in the apron by the foam body.

31. The table of claim 24 wherein:

the table top member has corners;

the table bottom element includes a substantially horizontal shelf between the apron and periphery along each corner;

a corner element is positioned on the shelf along each corner, and the foam body is formed around each corner element and joins each corner element to the table top member.

32. The table of claim 24 wherein:

the foam body includes an integral adhesive in contact with the core element and table top and bottom elements; and the adhesive joins the core element and table top and bottom table elements together to form the table top member.

33. The table of claim 24 wherein the foam body and support member comprise a separate formed-together element and, wherein:

the foam body and support member element has an outer surface configured to conform to the apron and cavity, said outer surface abutting corresponding surfaces of the apron and table top element; and an adhesive is on at least portions of the abutting surfaces, said adhesive joining the foam body and support member element, and the table top and bottom elements to form the table top member.

34. The table of claim 33 wherein the foam body includes an integral adhesive in contact with the core element and the integral adhesive joins the core element to the foam body and support member element along the inner edge and a core element outer edge.

35. The table of claim 33 further including an adhesive along the foam body inner edge and a core element outer edge and the adhesive joins the core element to the foam body.

36. The table of claim 24 wherein the foam body includes an integral adhesive and the foam body joins the support member to the table bottom element and the table further includes:

an upper surface provided in the foam body, said upper surface abutting a corresponding table top element surface; and an adhesive on the abutting foam body and table top surfaces, said adhesive joining the foam body and table top element to form the table top member.

37. The table of claim 36 further including an adhesive along the foam body inner edge and a core element outer edge and the adhesive joins the core element to the foam body.

38. The table of claim 24 further including opposed brackets each forming an attachment point for securing at least one of the legs to the table top member, each bracket comprising:

a generally L-shaped body with first and second ends;

a rail-receiving clip formed in the body along the first end, said clip comprising opposed side walls and a bottom wall configured for attachment around a rail without fasteners; and a leg attachment region comprising a flat portion between the clip and second end and generally parallel to the table bottom element.

39. In a lightweight, portable table including a unitized table top member and legs secured thereto, the improvement wherein the table top member comprises:

a substantially planar table top element;

a table bottom element, the top and bottom elements forming a cavity therebetween and a table top member periphery;

a support member in the cavity and extending along the periphery;

a hardened foam body at least partially surrounding the support member, said foam body connecting the table top and bottom elements and the support member; and a core element joined to the table top member and foam body within the cavity in a core-receiving space defined by the table top and bottom elements and the foam body.

40. The table of claim 39 further including:

an apron depending from the table bottom element and extending adjacent the periphery, said apron forming a portion of the cavity; and the foam body is of sufficient volume to at least partially fill the apron to secure the support member in the apron.

41. The table of claim 40 wherein the support member:

is made of a lightweight solid metal material; and has a height dimension and a thickness dimension, the height dimension being greater than the thickness dimension.

42. The table of claim 41 wherein:

the support member comprises plural elements each having ends; and the elements are arranged in the apron one after the other with adjacent ends positioned in overlapping side by side relationship, said overlapping ends being held in place in the apron by the foam body.

43. The table of claim 40 wherein:

the table top member has corners;

the table bottom element includes a substantially horizontal shelf between the apron and periphery along each corner;

a corner element is positioned on the shelf along each corner; and the foam body is formed around each corner element and joins each corner element to the table top member.

44. The table of claim 39 wherein the foam body is a material selected from the group consisting of urethane foam, polyethylene foam and expanded polystyrene.

45. The table of claim 39 wherein the core element has an outer edge around the core element and the outer edge is joined to the foam body inner edge.

46. The table of claim 45 wherein the core element is made of a lightweight material and includes plural cells defining void volumes.

47. The table of claim 46 wherein the core element comprises a honeycomb core element having a plurality of vertical walls in a substantially regular geometric pattern defining the cells.

48. The table of claim 39 further including opposed brackets each forming an attachment point for securing at least one of the legs to the table top member, each bracket comprising:

a generally L-shaped body with first and second ends;

a rail-receiving clip formed in the body along the first end, said clip comprising opposed side walls and a bottom wall configured for attachment around a rail without fasteners; and a leg attachment region comprising a flat portion between the clip and second end and generally parallel to the table bottom element bottom surface.

49. In a lightweight, portable table including a unitized table top member and legs secured thereto, the improvement wherein the table top member comprises:

a substantially planar table top element;

a table bottom element, the top and bottom elements forming a cavity therebetween and a table top member periphery;

a support member in the cavity and extending along the periphery;

a hardened foam body at least partially surrounding the support member, said foam body being joined directly to the table top and bottom elements and securing the support member within the cavity; and a core element joined to the table top member and foam body within the cavity in a core-receiving space defined by the table top and bottom elements and the foam body.

* * * * *